US005501053A

United States Patent [19]

Goleby

[11] Patent Number: 5,501,053

[45] **Date of Patent: *Mar. 26, 1996**

[54] INTERENGAGEABLE STRUCTURAL MEMBERS

[75] Inventor: Leslie D. Goleby, Acicia Ridge, Australia

[73] Assignee: Tube Technology Pty., Ltd., Australia

[ * ] Notice: The term of this patent shall not extend beyond the expiratin date of Pat. No. 5,163,225.

[21] Appl. No.: 30,207

[22] PCT Filed: Sep. 25, 1991

[86] PCT No.: PCT/AU91/00441

§ 371 Date: Mar. 26, 1993

§ 102(e) Date: Mar. 26, 1993

[87] PCT Pub. No.: WO92/05893

PCT Pub. Date: Apr. 16, 1992

[30] Foreign Application Priority Data

Sep. 28, 1990 [AU] Australia ..... PK2530

[51] Int. Cl.[6] ..... E04C 3/32; B23P 17/00

[52] U.S. Cl. ..... 52/729.5; 52/579; 52/588.1; 52/729.1; 52/731.7; 29/397.3; 29/897.32; 29/897.35; 403/218; 403/331

[58] Field of Search ..... 29/897, 897.3, 29/897.32, 897.35, 557; 52/731.7, 579, 102, 588.1, 729.1, 729.2, 729.3, 729.5; 403/331, 381, 217, 218, 219

[56] References Cited

U.S. PATENT DOCUMENTS

| | | | |
|---|---|---|---|
| Re. 21,921 | 10/1941 | Greulich | 29/897.35 X |
| D. 27,394 | 7/1897 | Horton . | |
| D. 28,864 | 6/1898 | Baker . | |
| D. 32,294 | 2/1900 | Bissel . | |
| 426,558 | 4/1890 | Dithridge | 52/729 X |
| 991,603 | 5/1911 | Brooks | 52/364 |
| 1,341,949 | 6/1920 | Troye . | |
| 1,377,251 | 5/1921 | Hunker . | |
| 1,454,659 | 5/1923 | Thurston . | |

(List continued on next page.)

FOREIGN PATENT DOCUMENTS

| | | |
|---|---|---|
| 121608 | 6/1946 | Australia . |
| 124770 | 6/1947 | Australia . |
| 59988/69 | 6/1971 | Australia . |
| 61568 | 8/1973 | Australia . |
| 58083/73 | 3/1977 | Australia . |
| 68793 | 3/1977 | Australia . |
| 39587/78 | 3/1980 | Australia . |
| 81034 | 5/1981 | Australia . |

(List continued on next page.)

OTHER PUBLICATIONS

Derwent Abstract Accession No. A3410A/02, Class P52 (Mosc Aviatn Techn) Jun. 10, 1977.

Derwent Abstract Accession No. 91–071965/10, Class P52, SU, A, 1558–529 (Ukr Metals Res Inst) Apr. 23, 1990.

Patents abstracts of Japan M78, p. 57, JP, A, 56–50724 (Nitsutetsu Kenzai K.K.) Aug. 5, 1981.

Patent Abstracts of Japan, M660. p. 14, JP, A, 62–176611 (Nisshin Steel Co Ltd) Mar. 8, 1987.

*Primary Examiner*—Carl D. Friedman
*Assistant Examiner*—Kevin D. Wilkens
*Attorney, Agent, or Firm*—Nixon & Vanderhye

[57] ABSTRACT

Structural members (80) having an intermediate web (81) and hollow tubular side flanges (83, 85) extending longitudinally of the web (81) are formed in a cold rolling operation such that one of the tubular side flanges (83) has an outside diameter of the opposite tubular side flange (85). The larger diameter side flange (85) has a longitudinally slotted aperture (87) to permit a composite structure (120) to be formed by nesting the smaller diameter flange (83) in the larger diameter flange (85) of an adjacent structural member (80). The composite structure (120) having a plurality of interconnected structural members (80) may be assembled as a closed or open structure.

19 Claims, 15 Drawing Sheets

U.S. PATENT DOCUMENTS

| | | | |
|---|---|---|---|
| 1,623,939 | 4/1927 | Kraft . | |
| 2,127,618 | 8/1938 | Riemenschneider . | |
| 2,880,589 | 4/1959 | Wilson et al. | 52/588 X |
| 3,140,764 | 7/1964 | Cheskin . | |
| 3,199,174 | 8/1965 | Nilsson et al. . | |
| 3,241,285 | 3/1966 | Baroni . | |
| 3,256,670 | 6/1966 | Tersigni . | |
| 3,342,007 | 9/1967 | Merson | 52/729 |
| 3,349,537 | 10/1967 | Hopfeld | 52/729 |
| 3,362,056 | 1/1968 | Preller et al. | 52/729 X |
| 3,427,427 | 2/1969 | Rudd . | |
| 3,434,198 | 3/1969 | Bergantini . | |
| 3,452,433 | 7/1969 | Scofield . | |
| 3,517,474 | 6/1970 | Lanternier | 52/729 |
| 3,698,224 | 10/1972 | Saytes | 29/897.35 X |
| 3,713,205 | 1/1973 | Wogerbauer . | |
| 3,735,547 | 5/1973 | Moyer et al. . | |
| 3,827,117 | 8/1974 | Oilman . | |
| 3,860,781 | 1/1975 | Aschauer . | |
| 4,002,000 | 1/1977 | Howard et al. . | |
| 4,402,206 | 9/1983 | Yanazawa et al. . | |
| 4,433,565 | 2/1984 | Preller . | |
| 4,468,946 | 2/1984 | Driear . | |
| 4,586,646 | 5/1986 | Booher . | |
| 4,750,663 | 6/1988 | Warczak . | |
| 4,881,355 | 11/1989 | Bosl et al. . | |
| 5,163,225 | 11/1992 | Goleby | 29/897.35 |
| 5,373,679 | 12/1994 | Goleby | 52/720 X |

FOREIGN PATENT DOCUMENTS

| | | | |
|---|---|---|---|
| 81033 | 6/1981 | Australia . | |
| 80609 | 6/1981 | Australia . | |
| 83893 | 11/1981 | Australia . | |
| 82833 | 7/1982 | Australia . | |
| 84401 | 8/1982 | Australia . | |
| 527939 | 3/1983 | Australia . | |
| 733702 | 7/1966 | Canada . | |
| 107513 | 6/1967 | Denmark . | |
| 0132894 | 2/1985 | European Pat. Off. . | |
| 0181748 | 5/1986 | European Pat. Off. . | |
| 267843 | 5/1988 | European Pat. Off. . | |
| 2289694 | 5/1976 | France | 52/729 |
| 2374977 | 7/1978 | France . | |
| 2549933 | of 1985 | France . | |
| 561727 | 10/1937 | Germany . | |
| 812600 | 7/1949 | Germany . | |
| 1023120 | 1/1958 | Germany . | |
| 1132701 | 3/1962 | Germany . | |
| 2459421 | 6/1976 | Germany | 52/729 |
| 3319745 | of 1984 | Germany . | |
| 39989 | 1/1937 | Netherlands . | |
| 8300596 | 9/1984 | Netherlands . | |
| 131211 | 1/1975 | Norway . | |
| 444464 | 4/1986 | Sweden . | |
| 8504948 | 4/1987 | Sweden . | |
| 245935 | 10/1967 | U.S.S.R. . | |
| 827723 | 5/1981 | U.S.S.R. | 52/729 |
| 872690 | 10/1981 | U.S.S.R. . | |
| 968251 | 10/1982 | U.S.S.R. . | |
| 1026997 | 7/1983 | U.S.S.R. . | |
| 1651 | of 1858 | United Kingdom . | |
| 1575742 | 9/1920 | United Kingdom . | |
| 504146 | 4/1939 | United Kingdom | 29/897.32 |
| 518727 | 4/1940 | United Kingdom . | |
| 646646 | 3/1950 | United Kingdom . | |
| 2093886 | 4/1982 | United Kingdom . | |
| 2102465 | 5/1983 | United Kingdom . | |
| 2145145 | 6/1985 | United Kingdom . | |
| WO90/01091 | 2/1990 | WIPO . | |
| WO92/05895 | 4/1992 | WIPO . | |

104
103
104
102
101

101

INTERENGAGEABLE STRUCTURAL MEMBERS

This invention is concerned with novel structural members and a process for manufacturing same.

International patent application Ser. No. PCT/AU89/00313 describes a method for formation of structural members wherein a single strip of metal is continuously cold roll-formed to provide a central web with a hollow flange extending along each longitudinal edge. Although the central web is usually planar it may be contoured in a transverse direction. The hollow flanges may be formed in any suitable cross sectional shape such as circular, rectangular, triangular or the like and they may be of the same or different sizes.

In a further Australian patent application Ser. No. (PCT/AU91/00442) there is described a substantial improvement in the method and structure of the structural members disclosed in earlier International patent application Ser. No. PCT/AU89/00313. This further application describes the formation of structural members comprising at least one web having at least one hollow flange extending along a longitudinal edge thereof.

The improvement described in the further application relates to the continuous fabrication in cold roll forming machines of structural members formed from a multiplicity of separate metal strips. This improved process enables the manufacture of structural members having a web (or webs) and a hollow flange (or flanges) wherein the web and flange components may be comprised of differing metal thicknesses and grades depending upon the requirement of the structural member. In addition, the improved process enables structural members to be formed in a wide variety of configurations.

The present invention relates to new and improved structural members and novel uses therefor, the new and improved structural members being fabricated generally in accordance with the processes of the abovementioned applications. Accordingly, the disclosures of patent applications PCT/AU89/00313 and PCT/AU91/00442 are incorporated herein by way of cross reference and references herein to "roll forming" as it relates to the invention, the subject of this patent application mean "cold rolling forming".

According to one aspect of the present invention there is provided a structural member comprising:

a first hollow flange and a second flange extending longitudinally of an intermediate web, said first flange including a slotted aperture extending longitudinally thereof in a direction parallel to a longitudinal axis of said first flange.

The second flange may comprise a solid element although preferably the second flange is hollow. If required said first and second flange may be hollow and both of said first and second flanges may include a slotted aperture extending longitudinally thereof.

Suitably said first flange is adapted to receivably locate within its interior a flange of an adjacent structural member comprising at least one web element and at least one flange element extending longitudinally of an edge of said web element, said web element extending through said slotted aperture when said at least one flange element is receivably located within the interior of said first flange.

Suitably, the second flange has a cross sectional area less than the cross sectional area of the interior of the first hollow flange.

The first and second hollow flanges may have the same or different cross sectional shapes.

Preferably the cross sectional shapes of said first and second flanges are similar or identical.

Most preferably first flange may be adapted in use to receivably locate a second flange of an adjacent substantially identical structural member.

The intermediate web member may be substantially planar or alternatively it may be contoured transversely of a longitudinal axis of said structural member.

If required, the web and the first and second flanges may comprise the same grade and thickness of metal or differing grades and thickness of metal.

Suitably the slotting aperture may be in the same plane as the intermediate web or in another plane inclined thereto.

The slotted aperture may be of a width such as to substantially restrain relative rotational motion about a longitudinal axis between said first flange and a flange receivably located therein or alternatively the width of said slotted aperture may be such as to permit at least limited rotational motion between said first flange and a flange receivably located therein.

According to a second aspect of the invention there is provided a composite structure comprising:

two or more structural members having an intermediate flange and a spaced parallel side flanges, at least one of said side flanges comprising a hollow flange having a slotted aperture extending longitudinally thereof, said hollow flange receivably locating a side flange of an adjacent structural member.

Suitably at least one of said structural members includes a slotted hollow side flange adopted to receive two or more side flanges of adjacent structural members.

The composite structure may comprise a plurality of structural members each interconnecting with an adjacent structural member to form a substantially planar or non planar open composite structure.

Alternatively the composite structure may comprise a plurality of structural members each interconnecting with one or more adjacent structural members to form a single closed composite structure or a composite structure comprising open and closed portions.

The composite structure may comprise a rigid structure wherein relative movement between adjacent structural members is restrained by limiting relative rotation between a hollow flange having a slotted aperture and a flange of an adjacent structural member receivably located therein.

Alternatively the composite structure may comprise a flexible structure wherein at least limited rotational movement between adjacent structural members is permitted.

According to yet another aspect of the invention there is provided a method of manufacture for a structural member comprising the steps of:

fabricating a structural member having an intermediate web and side flanges extending longitudinally of said web, at least one of said side flanges comprising a hollow aperture extending longitudinally thereof, and;

forming a slotted aperture longitudinally of a wall of said at least one side flange.

The structural member may be formed by any suitable fabrication process but preferably is formed in a cold roll forming operation from a single strip of metal or from a plurality of strips of metal.

The slotted aperture may be formed by any suitable process of metal removal. For example the metal in the region of the slotted aperture may be removed by abrasion with a grinding wheel or a strip of metal may be removed by cutting wheels, shears or the like. Alternatively a strip of metal may be removed by a gas plasma metal cutting apparatus or a laser cutting apparatus.

The slotted aperture may also be formed by a roll forming process wherein the hollow flange is formed from a strip of metal leaving the free edges of the strip separated. Alternatively the slotted aperture may be formed by a roll forming process wherein a hollow tubular member is initially formed followed by an inward deformation of the tubular member to form a double walled hollow flange with a slotted aperture extending longitudinally thereof.

In order that the various aspects of the invention may be more fully understood, preferred embodiments will now be described with reference to the accompanying drawings in which FIG. 1 shows schematically the development of cross sectional shape in a roll formed structural member formed from a single strip of metal.

FIG. 6*a* through *h* show schematically cross sections during the roll forming of a hollow flanged structural member fabricated from separate strips of metal.

Figure 7:
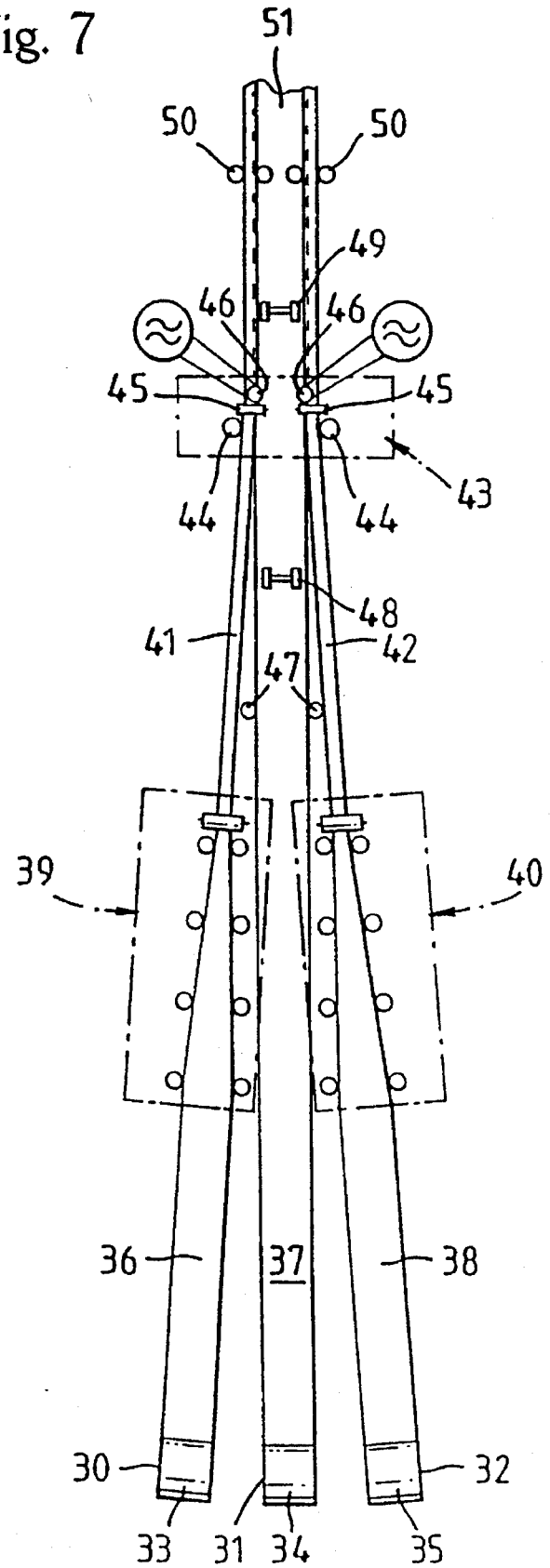
Figure 6A:
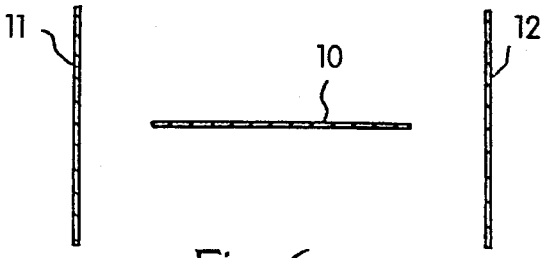
Figure 6E:
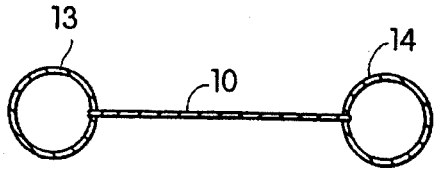
Figure 6B:
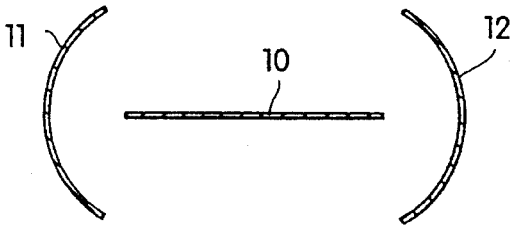
Figure 6F:
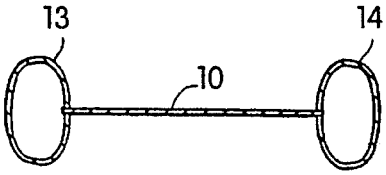
Figure 6C:
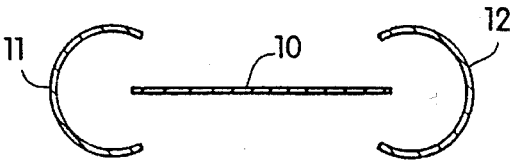
Figure 6G:
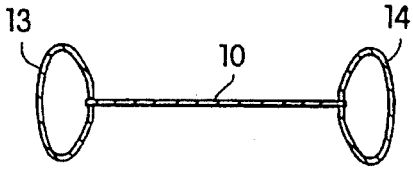
Figure 6D:
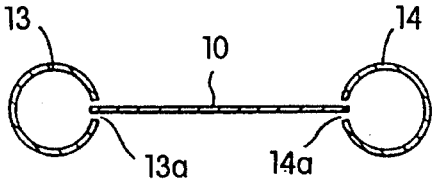
Figure 6H:
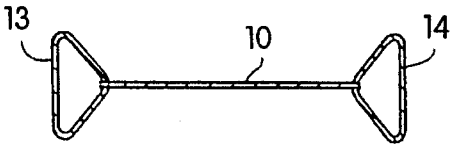
Figure 8:
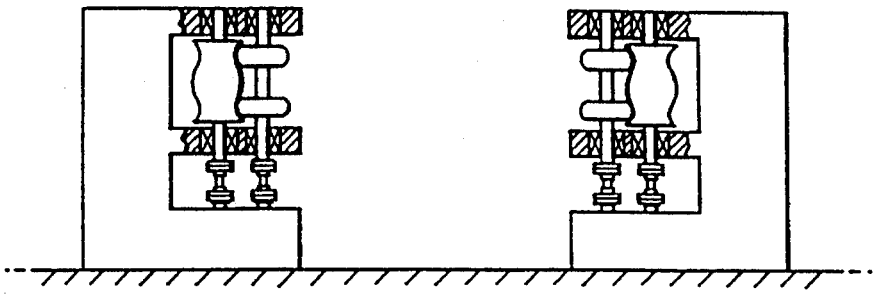
Figure 9:
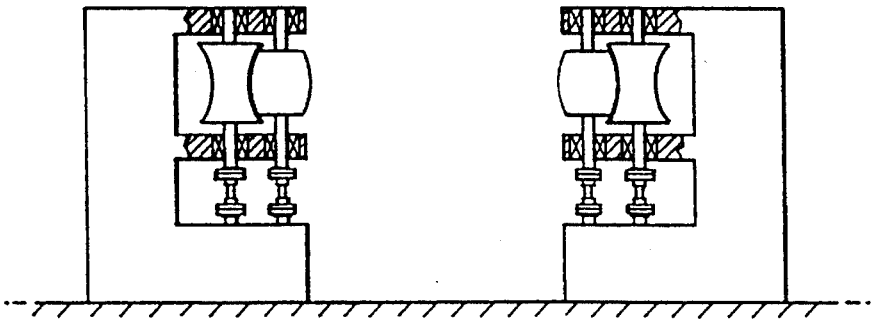
Figure 10:
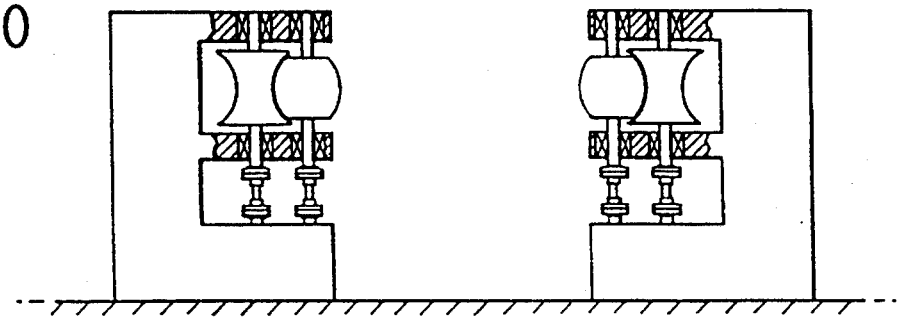
Figure 11:
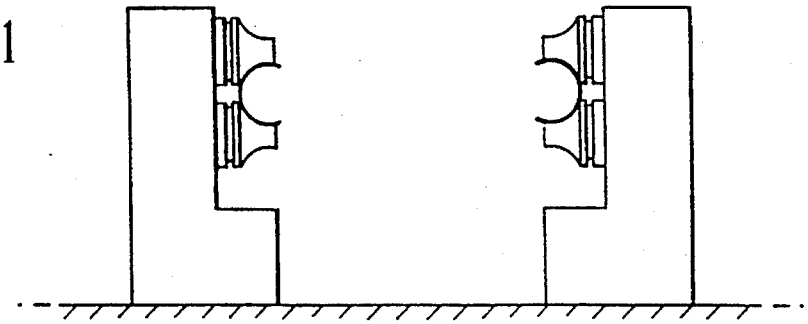
Figure 12:
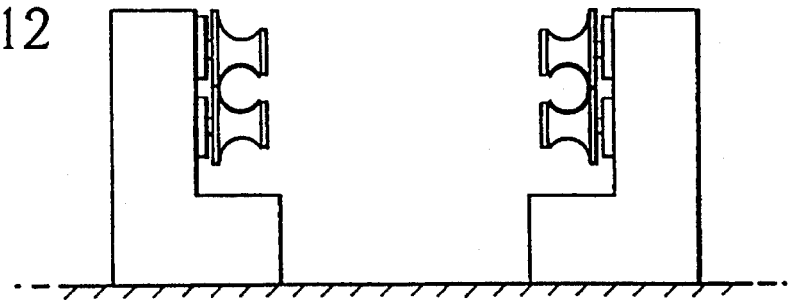
Figure 13:
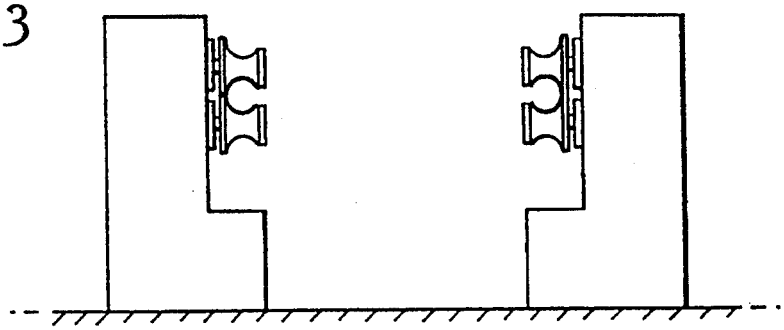
Figure 14:
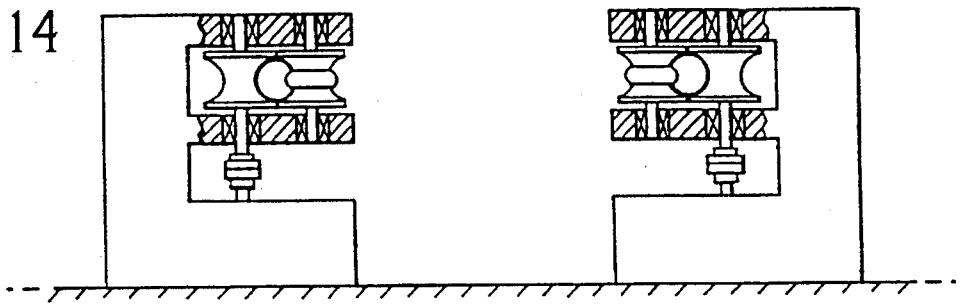
Figure 15:
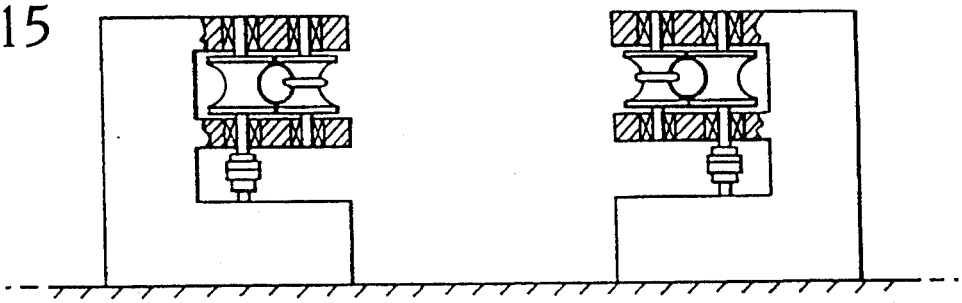

FIG. 7 shows schematically a roll forming apparatus to produce the roll formed section of FIG. 6.

FIGS. 8–15 show schematically typical profiling stations in the roll forming apparatus of FIG. 7.

Figure 16:
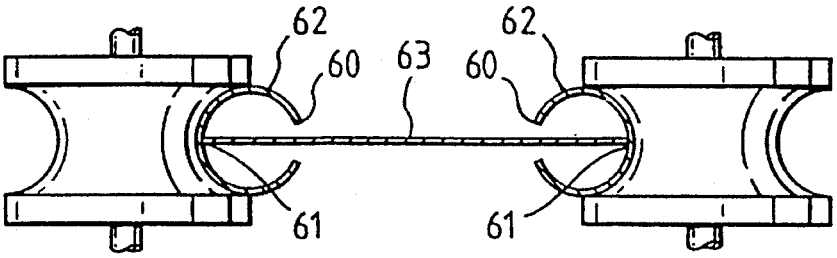
Figure 17:
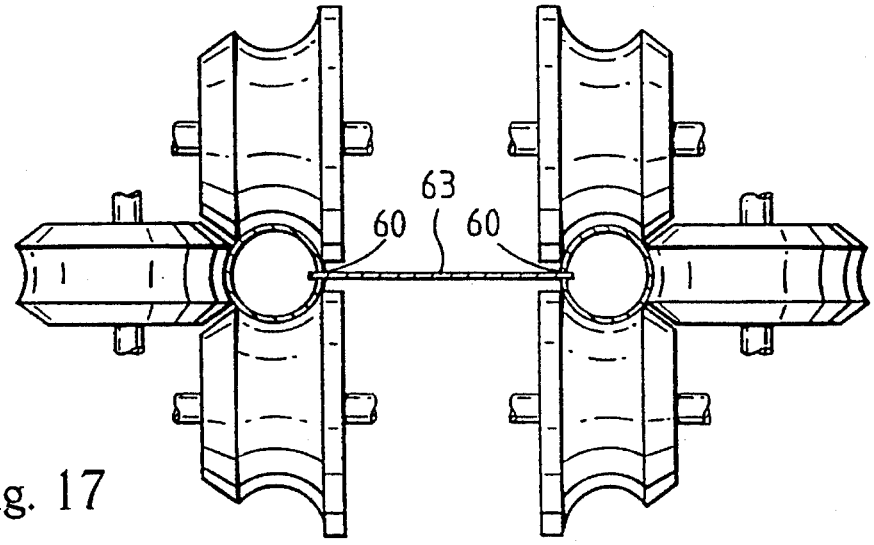
Figure 18:
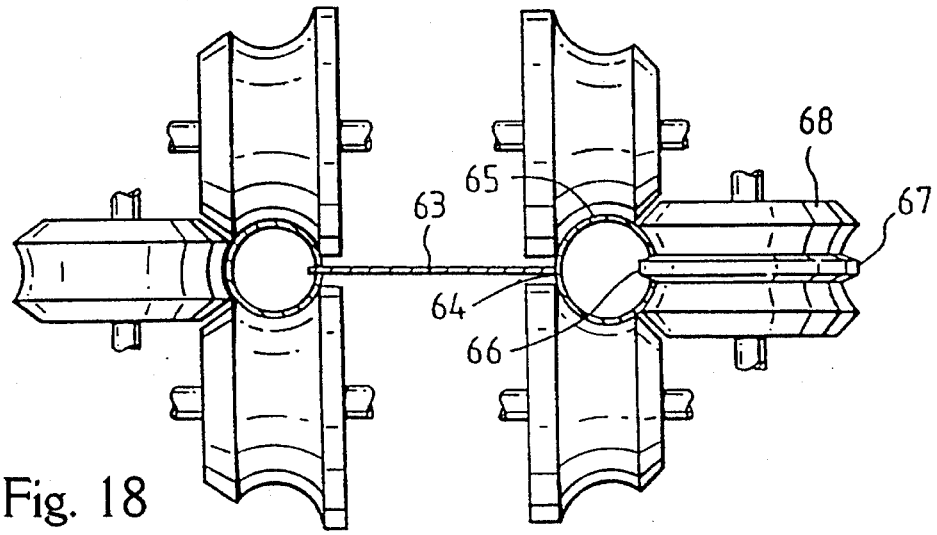

FIGS. 16–18 show alternative forms of attachment of hollow flanges to web sections.

Figure 19A:
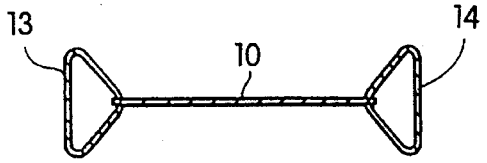
Figure 19B:
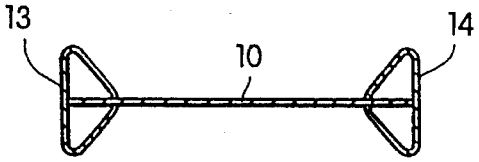
Figure 20A:
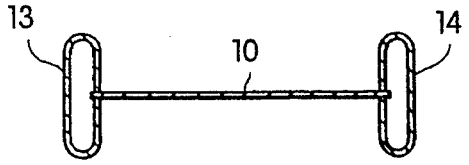
Figure 20B:
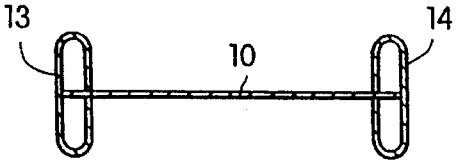
Figure 21A:
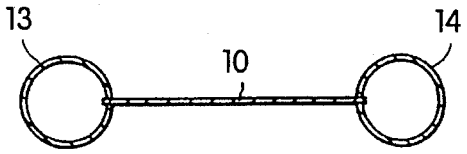
Figure 21B:
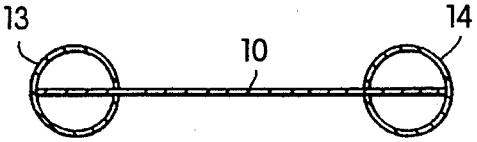
Figure 22A:
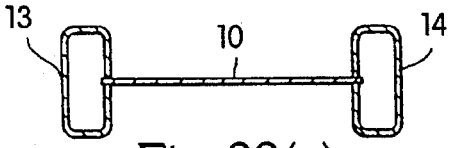
Figure 22B:
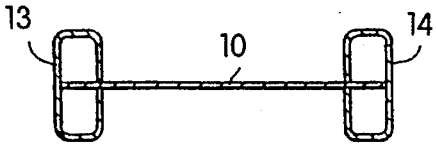
Figure 23A:
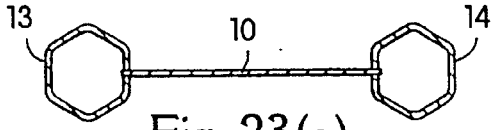
Figure 23B:
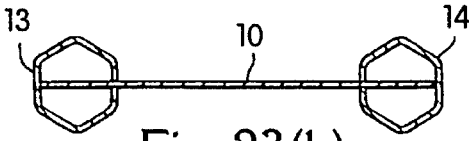

FIGS. 19*a* and *b* through FIGS. 23*a* and *b* illustrate a non-exhaustive array of alternative cross sectional profiles of structural members.

Figure 24:
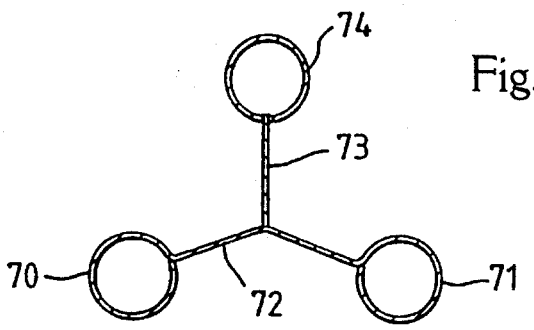

FIG. 24 shows schematically a composite beam structure.

Figure 25:
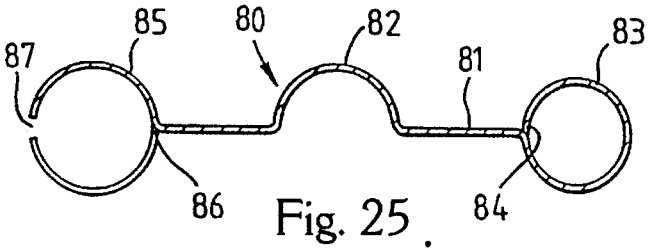

FIG. 25 shows a cross sectional profile of a structural member according to the present invention.

Figure 26:
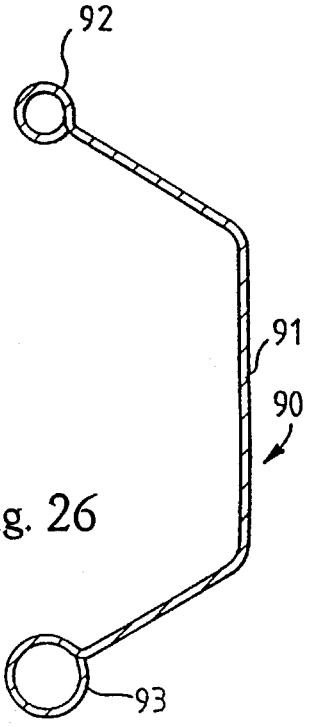

FIG. 26 shows a further cross sectional profile of a structural member according to the present invention.

Figure 27:
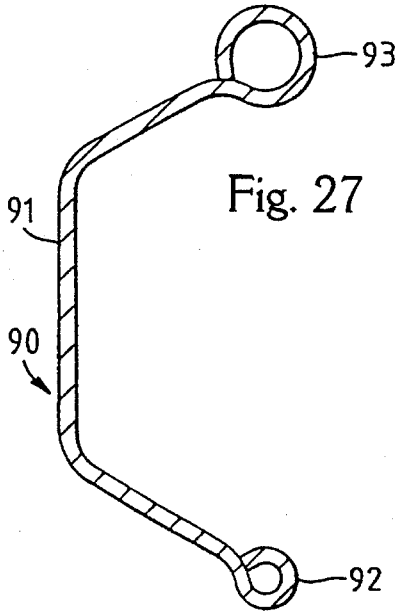

FIG. 27 shows another cross sectional profile according to the invention.

Figure 28:
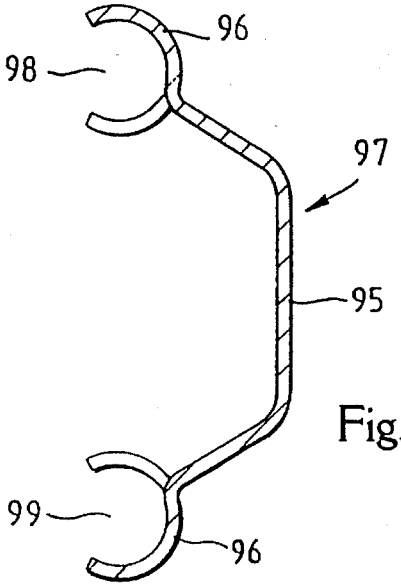

FIG. 28 shows yet another cross sectional profile.

Figure 29:
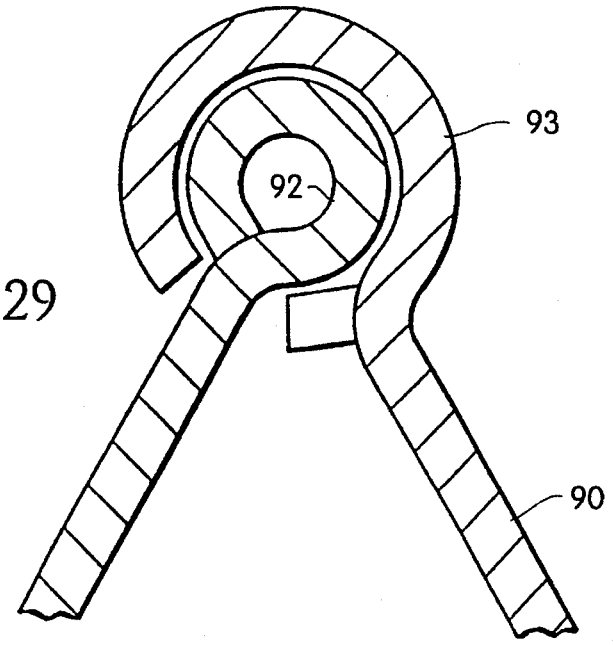
Figure 30:
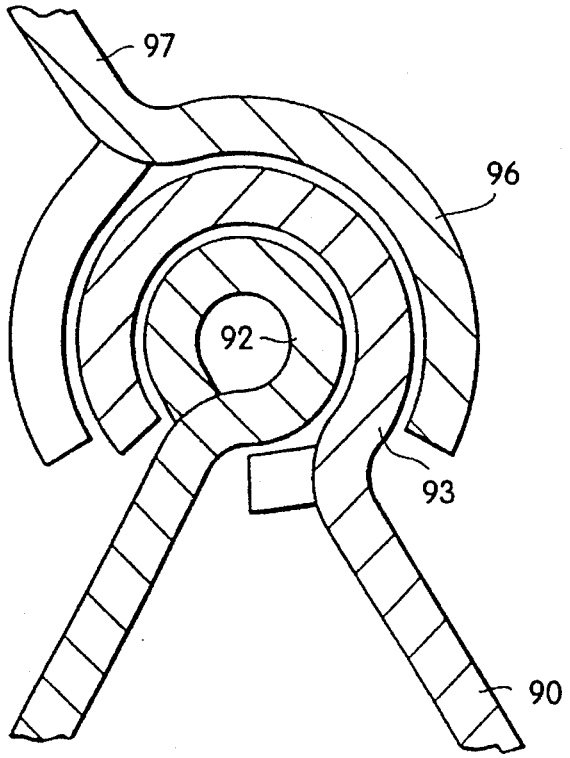

FIGS. 29 and 30 show enlarged cross sectional views of interengaging hollow flanges.

FIG. 31 shows a non-exhaustive array of composite structures according to the invention.

Figure 32:
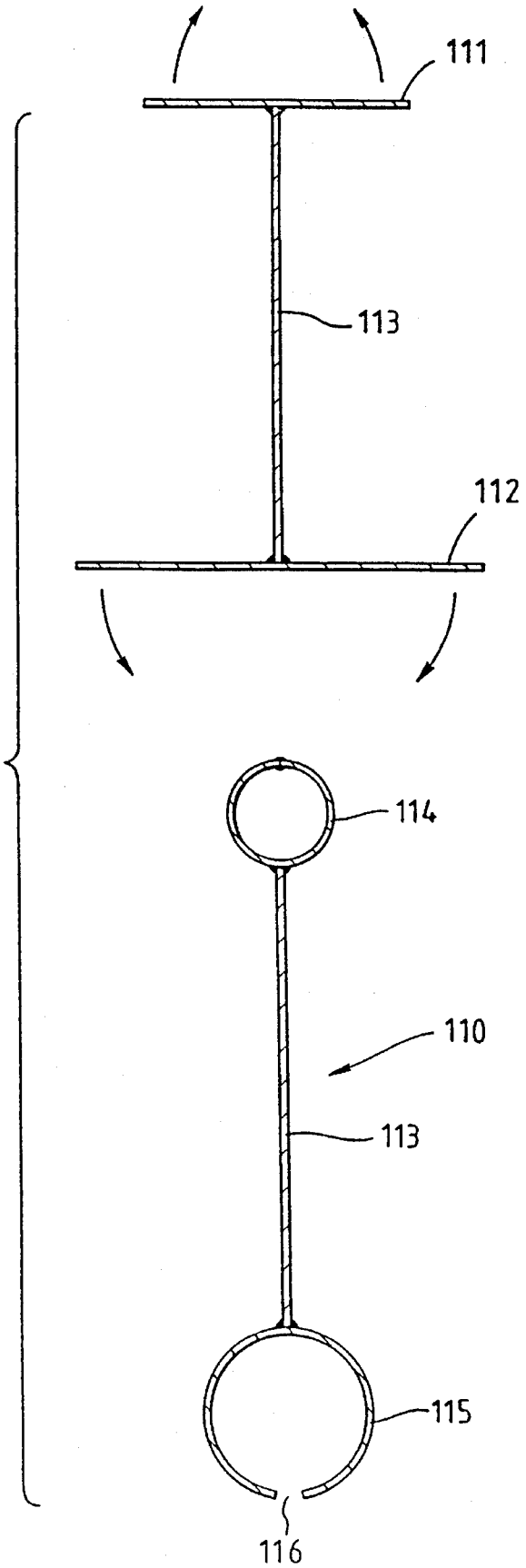
Figure 33:
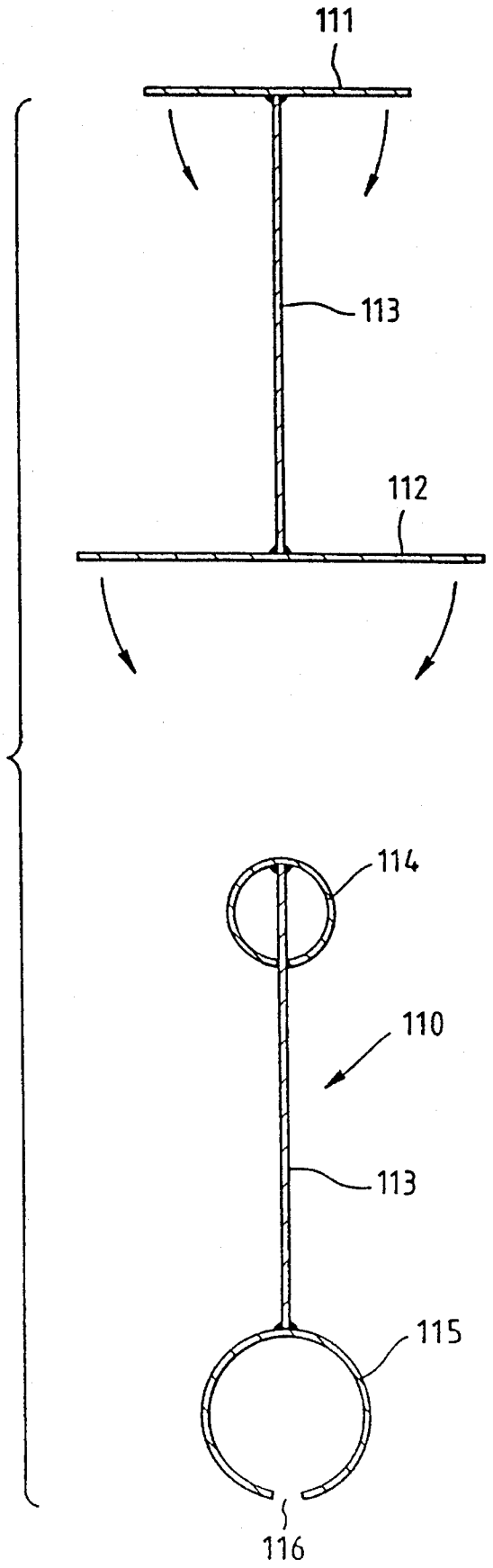

FIGS. 32 and 33 show schematically alternative methods for forming hollow flanged structural members.

Figure 34:
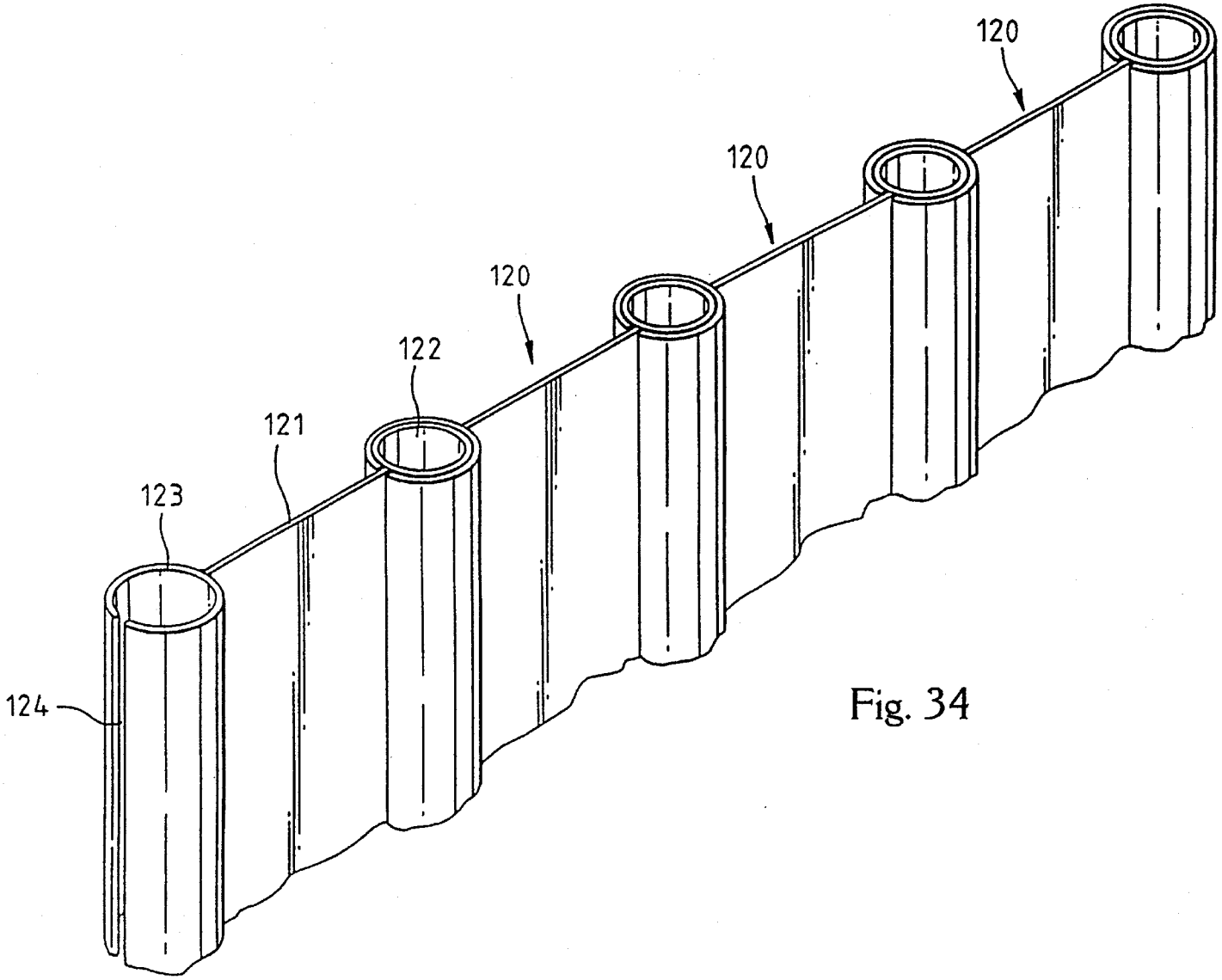

FIG. 34 shows a composite structure according to yet a further aspect of the invention.

Figure 35:
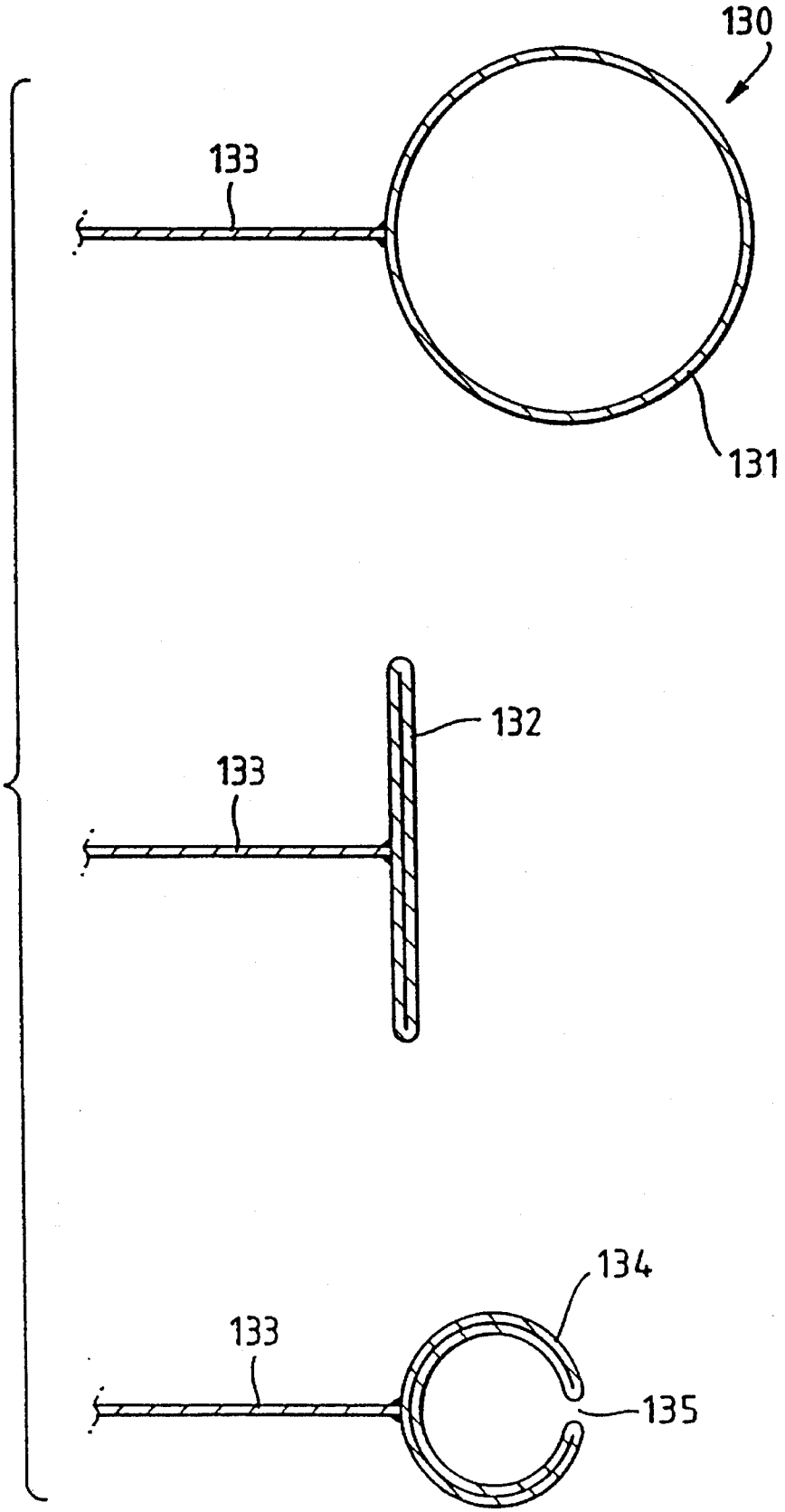

FIG. 35 shows schematically a further method for forming a structural member with one or more slotted hollow flanges.

Figure 1:
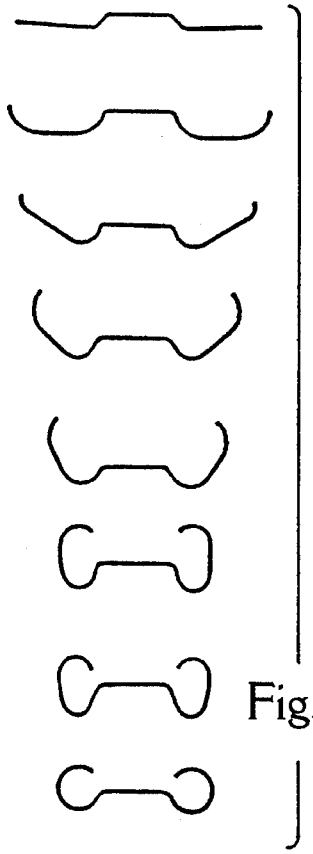

FIG. 1 shows schematically a typical development of a cross sectional profile from a single strip of metal according to the process described in application Ser. No. PCT/AU88/00313.

Figure 2:
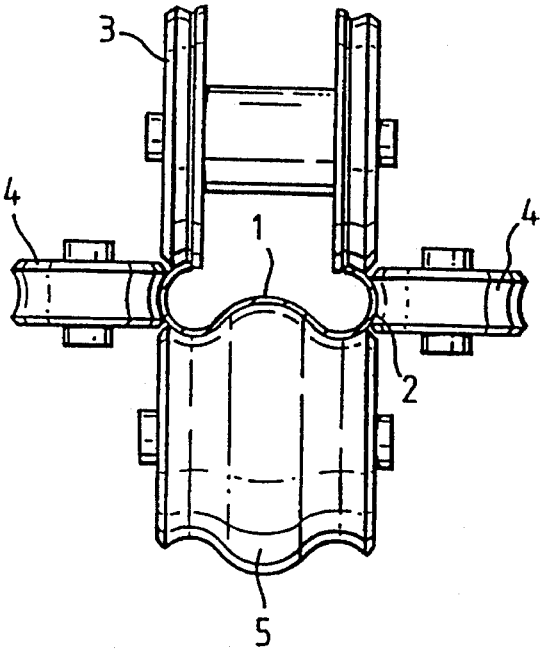
FIGS. 2–4 show typical work station roller profiles to develop the cross sectional shapes illustrated in FIG. 1.
Figure 3:
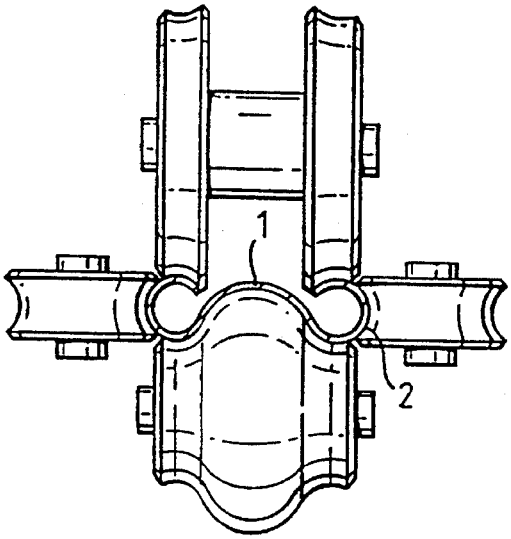
Figure 4:
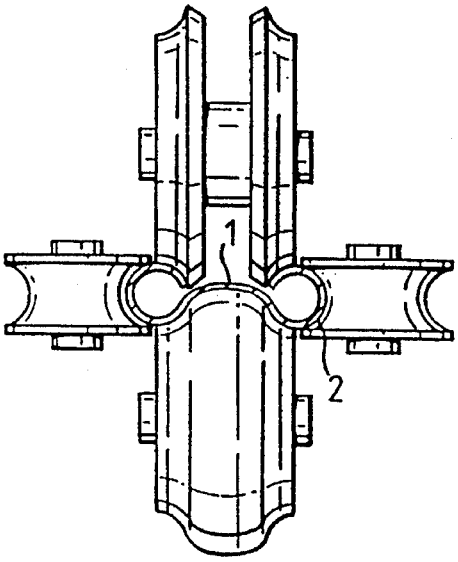

As shown in greater detail in FIGS. 2–4 a planar strip of metal is progressively deformed to produce a cross sectionally arcuate intermediate web 1 with hollow flanges 2 having a generally circular cross-section extending longitudinally of web 1. Although deforming and shaping roller sets 3, 4 and 5 as shown co-operate to produce hollow flanges 2 of identical cross-sectional diameter, it will be clear to a skilled addressee that with appropriate modification, roller sets 3,4 and 5 may be adapted to produce hollow flanges 2 of differing cross sectional diameters and/or shape.

Figure 5:
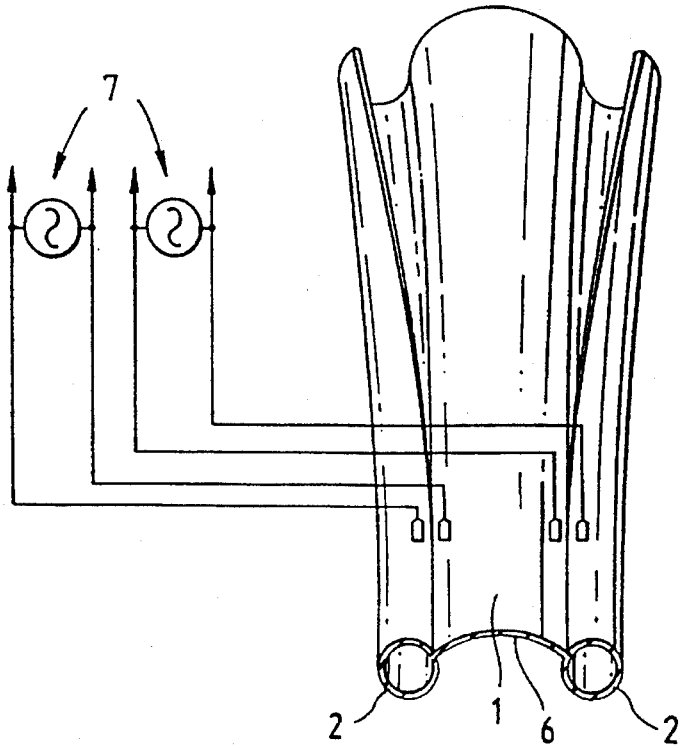
FIG. 5 shows schematically the welding of the free edges of the hollow flanges of the section illustrated in FIGS. 1–4.

FIG. 5 shows schematically the continuous welding of the free edges of hollow flanges 2 to the central web 1 to form a structural member having immense structural integrity and fluid tight hollow flanges 2.

Welding of the free edges of flanges 2 is suitably effected by a high frequency electrical induction or resistance welding apparatus shown generally at 7. After welding, the central web 2 may be reshaped by further deforming or shaping rollers (not shown) to produce a web 2 having a planar or profiled cross sectional shape.

FIG. 6 shows schematically the development of a structural member from separate strips of metal according to a process and apparatus described in Australian patent application Ser. No. PCT/AU91/00442.

At stage 1, metal strips representing web strip 10 and flange strips 11, 12 are fed into a tandem station roll forming apparatus or alternatively flange strips 11, 12 are passed through separate roll forming mills while web strip 10 passes therebetween.

Strips 11, 12 are progressively deformed to produce hollow side flanges 13, 14 having elongate slotted apertures 13*a*, 14*a* respectively as shown at stage 4. The hollow flanges 13, 14 are guided towards web strip 10 until the free edges of web strip 10 are located within slotted apertures 13*a*, 14*a*. The free edges of flanges 13, 14 are then urged into contact with web strip 10 as shown at stage 5 by opposing rollers in the region of a welding station wherein the free edges of flanges 13, 14 are welded to web strip 10 to form an integral structure.

Flanges 13, 14 may then be shaped to any desired shape as illustrated at stages 6–8 by shaping rollers located downstream of the welding station.

FIG. 7 shows schematically an apparatus used to produce the structural member of FIG. 1.

In FIG. 7 the apparatus comprises separate let-off stations 30, 31, 32 each supporting separate coiled rolls 33, 34, 35 of sheet steel, each of the same or different thickness and width if required. Strips 36 and 38 issuing from rolls 33, 35 respectively are directed to roll forming mills 39,40 to form hollow members 41, 42 respectively of predetermined shape and cross sectional area. As illustrated at stage 4 in FIG. 6, the respective pairs of free edges are slightly separated to form continuous slots which face a respective edge of central strip or web 37.

In the region of welding station 43 the free edges of web 37 are guided by rollers 44 into the respective slots in adjacent hollow members 41, 42 to a respective distance equal to the respective wall thicknesses of members 41, 42. Nip rollers 45 compress members 41,42 to urge their respective free edges into contact with upper and lower surfaces of web 37 immediately prior to welding by high frequency electrical induction or resistance welding units 46. Rollers 47, 48, 49 and 50 initially support web 37 and subsequently the integral structure 51.

The structure 51 is then severed into predetermined lengths by a flying saw (not shown) or the like.

Suitably roll forming mills 39, 40 are laterally movable to accommodate differing widths of web 37.

FIGS. 8–15 show schematically typical rolling stations which may be employed in rolling mills 39, 40 in FIG. 7 to produce the hollow flange members 13, 14 shown at stage 4 in FIG. 6.

A number of significant variations may be made to the method and apparatus of the invention to achieve a wide variety of structural members.

FIG. 16 shows, for example, that the system of FIG. 7 may be adapted such that in the process of welding the lips 60 of a slotted tubular member to the opposing surfaces of a web member 63, a free edge 61 of the web member may be guided fully into either or both of the tubular members 62 until it engages the inner wall of the tubular member. If required the free edge of the web 63 may be additionally welded to the interior of the tubular member 62 by high frequency induction welding to form a hollow flange divided into separate fluid tight compartments.

FIG. 17 shows an alternative configuration wherein lips 60 are welded to opposing faces of web 63 adjacent its edges.

FIG. 18 shows yet another configuration wherein a free edge 64 of web 63 is welded to the outer surface of a hollow flange 65 having a slotted aperture 66 extending longitudinally thereof diametrically opposite the attachment point of web 63. Slotted aperture 66 is formed by leaving the free edges 65*a* of flange 65 separated and maintaining the separation at a predetermined spacing during the shaping process by projections 67 on outer rolls 68.

In other variations the central web may include pre or post formed apertures or it may include a longitudinally or transversely extending profiled shape in the form of deep or shallow channels, ribs or the like. In the case of transversely extending contoured profiles, the inwardly facing regions of opposed hollow flanges include planar faces arranged perpendicularly to the edges of the web to facilitate welding of the components of the structural member.

FIGS. 19*a* and *b* through FIGS. 23*a* and *b* show a non-exhaustive array of flange shapes comprising an intermediate web 10 and opposed hollow flanges 13, 14 according to the invention disclosed in Australian application Ser. No. PK2531.

FIG. 24 in particular shows a composite structure formed in accordance with the inventions disclosed in both Australian application Ser. No. PCT/AU88/00313 and Ser. No. PCT/AU91/00442. In this structure the lower portion comprising flanges 70, 71 and web 72 is formed from a single strip of metal in accordance with application PCT/AU88/00313 to which is subsequently added web 73 and hollow flange 74 (formed from separate strips of metal) in accordance with the invention described in Australian application Ser. No. PK2531.

Reference to FIGS. 1–24 and the disclosures of patent application Ser. Nos. PCT/AU88/00313 and PCT/AU91/00442 is for the purpose of a clearer understanding of the present invention and it should be understood that the disclosures of these applications are incorporated herein by way of cross reference and the configurations, shapes and fabrication processes of structural members are applicable to adaptation in accordance with the present invention.

FIG. 25 shows a cross-sectional configuration of a structural member 80 formed in accordance with the present invention. The structural member 80 comprises a web 81 having an arcuate stiffening rib 82 formed therein. A hollow flange 83 has its free edge 84 welded to web 81 to form a fluid impervious conduit.

A second hollow flange 85 is formed on the opposite side of web 81 and the free edge 86 of flange 85 is also welded to web 81. A slotted aperture 87 is formed in the wall of flange 85 in the same plane as web 21.

The outer diameter of flange 83 is slightly smaller than the inner diameter of flange 85 whereby adjacent structural members 80 may be interconnected to form a composite structure by lengthwise slidingly engaging small flange 83 of one structural member within a large flange 85 of another structural member.

The structural member 80 may be formed from one or more strips of metal as generally described above and the slotted aperture is formed after the free edge 86 of flange 85 is welded to web 81. The slotted aperture is formed continuously by a gas plasma or laser cutting apparatus and the strip of metal removed is discarded as scrap.

FIG. 26 shows an alternative configuration of a structural member 90 wherein web 91 is formed as a channel-like section. Flange 92 is of a smaller diameter than flange 93 whereby after slotting flange 93, flange 92 may be slidingly located therein.

FIG. 27 shows a similar configuration to FIG. 26 except that a much thicker strip of metal is employed to fabricate the structural member 90.

FIG. 28 shows yet another embodiment of a structural member 97 comprising a channel shaped web 95 and a pair of hollow flanges 96 of equal diameter having large slotted apertures 98, 99, the purpose of which will be described with reference to FIGS. 29 and 30.

FIG. 29 is an enlarged cross sectional view of a small flange 92 of the structural member 90 shown in FIG. 27 engaged in a slotted aperture 100 of flange 93 of an adjacent structural member 90. Slotted aperture 100 is of a width greater than the thickness of web 91 to allow it limited pivotal movement between flanges 92 and 93.

FIG. 30 shows an enlarged cross sectional view of the interengaging flanges 92 and 93 of FIG. 29 engaged within a slotted flange 96 of structural member 97 shown in FIG. 28. Relative pivotal movement between flanges 92, 93 and 96 is permitted to at least a limited degree.

FIG. 31 illustrates composite structures permissable with the structural members illustrated generally in FIGS. 27, 28 and 29.

Figures 31A, 31B, 31C, 31D, 31E:
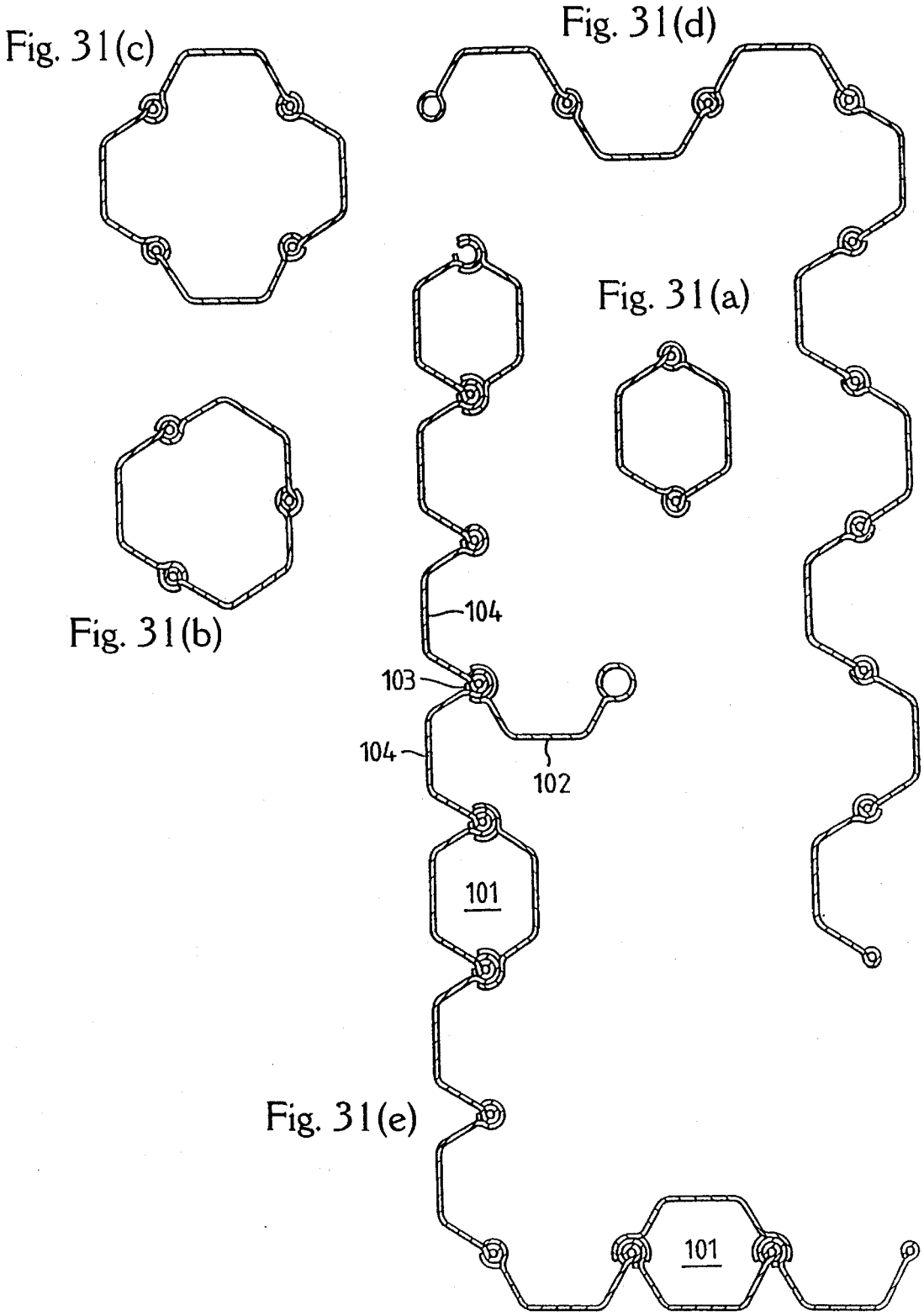

FIGS. 31*a*, 31*b* and 31*c* show cross sections of hollow columnar structures which may be utilized as structural columns, free standing poles or box beams. These structures may be hollow or filled with reinforced concrete (with or without pre-stressing steel reinforcing bars) or other reinforcing material such as carbon, synthetic or glass fibres in a resin matrix. If required, the columnar structures may also include post-stressed tendons.

FIG. 31*d* shows a composite structure comprising interconnected structural members shown generally in FIGS. 26 and 27. This composite structure may be utilized in an upright manner as a structural barrier such as a wall for a building, marine piling, shuttering for earthworks or the like.

In a horizontal configuration, the interconnected structural members may form a reinforced support for concrete slab floors, mine wall and roof reinforcing barriers or even as horizontal walling on a structural frame.

FIG. 31*e* shows yet another structural configuration comprising a combination of structural members illustrated in FIGS. 26, 27 and 28 wherein the structural members of FIG. 28 form spaced columns or box beams 101 to provide additional upright or transverse reinforcing to a barrier-like structure.

A structural member 102 interconnected to a junction 103 of adjacent interconnecting structural members 104 and arranged perpendicularly thereto may form an alternative form of structural support or reinforcing to a composite structure according to the invention.

FIG. 32 shows an alternative method of fabricating structural elements according to the invention.

The structural member 110 is fabricated by continuously forge welding flange strips 111, 112 to a web 113. Forge welding is a well known process for fabricating I- and T-beams and is generally described in U.S. Pat. No. 3,713,205.

Downstream of the forge welding station is a roll forming mill which deforms flange strips 111, 112 away from web 113 to form hollow flanges 114, 115. Hollow flange 114 is formed as a closed integral member by fusing together the free edges of flange strip 111 by high frequency electrical induction or resistance welding. Hollow flange 115 may be formed in a similar manner by fusing together the free ends of flange strip 112 and then subsequently forming slotted aperture 116 by removing a strip of metal by, say, a gas plasma or laser metal cutting apparatus.

Alternatively, slotted aperture 116 may be formed by roll forming flange strip 112 such that its free edges are spaced to form aperture 116.

FIG. 33 shows a variation of the process described in FIG. 32.

In this variation flange strip 111 is deformed towards web 113 and the free ends of flange strip 111 are fused to the sides of web 113 to form a hollow flange 114 which is internally reinforced by the edge portion of web 113.

The free ends of flange strip 111 are fused to web 113 by high frequency electrical induction or resistance welding.

FIG. 34 shows a composite structure comprising a plurality of structural members 120 each comprising a web 121 with a closed hollow flange 122 extending along one side of web 121 and a larger hollow flange 123 extending along the opposite side of web 121.

Hollow flange 123 includes a slotted aperture 124 extending longitudinally thereof and parallel to the plane of web 121. The internal diameter of flange 123 is chosen to accommodate an opposite smaller hollow flange of an adjacent structural member.

The composite structure so formed provides a sheet-like structure reinforced by hollow flanges 122 and 123. The width of slotted aperture 124 may be chosen to permit a relatively rigid composite structure or at least limited co-axial relative rotation between engaging flanges 123, 124 to permit an arcuate or contoured structure rather than the planar structure illustrated.

Such a composite structure may be employed as a structural support/lining for tunnels, bridge construction etc. In thin gauge metal, such a structure may be employed as roofing or wall cladding. In heavier gauges, the structure may be employed as piling or shuttering in earthworks.

In FIG. 35 a structural member 130 having a hollow flange 131 may be formed from a single metal strip by a process described in application Ser. No. PCT/AU90/00313 or from a plurality of metal strips by a process described in patent application Ser. No. PK2531.

The hollow flange 131 is when deformed in a continuous roll forming operation to flatten the flange to form a double walled planar flange 132 extending longitudinally of an edge of web 133.

Planar flange 132 is subsequently deformed by roll forming to produce a generally hollow double walled flange 134 with a longitudinal slot 135 extending therealong. While hollow slotted flange 133 is shown as generally circular in cross section it should be appreciated that the cross-sectional shape may be roll formed to any suitable cross section.

This variation of the process according to the invention may be employed to provide a reinforced hollow flange where the use of a thicker flange strip may not be possible or otherwise where the use of a thin flange strip is advisable for economic or process efficiency reasons.

It will be readily apparent to a skilled addressee that many modifications or variations may be made in the products and processes according to the invention without departing from the spirit and scope thereof.

I claim:

1. A method for the manufacture of structural members adapted for telescopic edge to edge engagement with a like structural member, said method comprising the steps of:

cold roll forming a structural member having an intermediate web member and opposed closed hollow side flanges extending along opposite sides of said web, said hollow side flanges being closed by welding the free edges thereof to respective junctions between the intermediate web and the hollow flanges; and forming a slotted aperture in at least one of said hollow side flanges, said slotted aperture extending between opposed ends of said hollow side flange parallel to said intermediate web.

2. A method as claimed in claim 1 wherein said structural member is formed in a continuous roll forming process from a single strip of material and the opposed free edges of the strip are welded by high frequency electrical induction or resistance welding to the surface of the strip at the junction between the hollow flange and the intermediate web.

3. A method as claimed in claim 2 wherein the slotted aperture is formed by removal of material from a closed wall of said hollow flange.

4. A method as claimed in claim 1 wherein the structural member is formed in a continuous roll forming process from separate strips of material comprising said intermediate web and at least one of said hollow flanges, wherein free edges of the strip comprising said at least one hollow flange are fused on opposite surfaces of said web adjacent an edge thereof by high frequency electrical induction or resistance welding.

5. A method as claimed in claim 4 wherein said slotted aperture is formed by removal of material from a closed wall of a hollow flange.

6. A method as claimed in claim 1 wherein said slotted aperture is formed by initially forming a hollow tubular flange which is subsequently deformed inwardly to form a double walled hollow flange with a slotted aperture extending between the ends thereof.

7. The method as claimed in claim 1 and wherein said slotted aperture is spaced from the junction of the web and said at least one hollow side flange having the slotted aperture therein to form flange wall portions extending from opposed faces of said intermediate web, said flange wall portions having spaced respective free edges defining the boundaries of said slotted aperture.

8. The method as claimed in claim 7 wherein the intermediate web and said hollow side flanges extending along opposed sides of said web are formed from the same strip of material.

9. The method as claimed in claim 7 wherein said apertured hollow side flange comprises a double walled structure.

10. The method as claimed in claim 7 wherein the intermediate web and at least one of said hollow side flanges are formed respectively from separate strips of material welded together.

11. The method as claimed in claim 7 wherein said slotted aperture is positioned in a hollow side flange wall at an angle of between 30° to 180° relative to a plane extending between the longitudinal axis of said hollow side flange and the junction of said hollow side flange and respective side of said intermediate web.

12. The method as claimed in claim 11 wherein both of said opposing hollow side flanges include a slotted aperture extending between respective ends thereof.

13. The method as claimed in claim 12 wherein said slotted aperture has a width such as to substantially restrain relative rotational movement between said apertured hollow flange and a telescopically engaged hollow flange of a like adjacent structural member.

14. The method as claimed in claim 11 wherein opposing hollow side flanges have substantially circular cross sections.

15. The method as claimed in claim 14 wherein said slotted aperture has a width such as to permit limited rotational movement of a telescopically engaged hollow flange of a like adjacent structural member without flexure of said aperture hollow side flange.

16. A cold roll formed steel structural member made in accordance with claim 1.

17. A composite structure comprising two or more edge to edge telescopingly engaged structural members made in accordance with the process of claim 1.

18. A composite structure as claimed in claim 17 wherein respective opposite hollow side flanges of a plurality of structural members are telescopically engaged with respective hollow side flanges of adjacent structural members to form a hollow structure.

19. A composite structure as claimed in claim 17 further including structural members having opposed apertured side flanges adapted to telescopically engage over a junction between said two or more telescopically edge to edge engaged adjacent structural members.

* * * * *